US005180159A

United States Patent [19]

Malick

[11] Patent Number: 5,180,159

[45] Date of Patent: Jan. 19, 1993

[54] ADJUSTABLE RIGHT ANGLE TRANSFER DEVICE FOR CONVEYING FLAT ARTICLES IN ONE OF TWO DIRECTIONS

[75] Inventor: Shahzad H. Malick, Fairfield, Conn.

[73] Assignee: Pitney Bowes Inc., Stamford, Conn.

[21] Appl. No.: 792,563

[22] Filed: Nov. 15, 1991

[51] Int. Cl.[5] ..... B65H 39/10

[52] U.S. Cl. ..... 271/302; 271/306; 271/184; 198/369; 198/436

[58] Field of Search ..... 271/225, 184, 185, 296, 271/299, 302-306, 69; 198/369, 436

[56] References Cited

U.S. PATENT DOCUMENTS

| | | | |
|---|---|---|---|
| 4,527,792 | 7/1985 | Burkhardt | 198/412 X |
| 4,724,945 | 2/1988 | Martin | 271/184 X |
| 4,726,461 | 2/1988 | Pokrinchak | 198/412 X |
| 4,756,521 | 7/1988 | Martin | 271/225 |
| 4,909,374 | 3/1990 | Skrypalle | 198/437 X |
| 4,928,807 | 5/1990 | Auerbach | 198/414 X |
| 4,986,730 | 1/1991 | Wetter | 271/185 X |
| 5,106,070 | 4/1992 | Reist | 271/225 X |

FOREIGN PATENT DOCUMENTS

| | | | |
|---|---|---|---|
| 1296093 | 5/1969 | Fed. Rep. of Germany | 198/369 |
| 0607766 | 5/1978 | U.S.S.R. | 198/369 |
| 0802139 | 2/1981 | U.S.S.R. | 198/436 |

*Primary Examiner*—H. Grant Skaggs
*Assistant Examiner*—Carol Lynn Druzbick
*Attorney, Agent, or Firm*—Charles R. Malandra, Jr.; Melvin J. Scolnick

[57] ABSTRACT

An apparatus for changing the direction of travel of a flat article being conveyed in a first direction to one of two other directions without changing the orientation of the article. The apparatus comprises a circular deck mounted on a frame. The deck is pivotable along a center axis of the deck between a left position and a right position. There is structure operatively coupled to the deck for conveying the article over the deck, the deck conveying structure having a first end and a second end, wherein, when the deck is in the left position, the deck conveying structure receives the article being conveyed in the first direction at the first end and conveys the article in a second direction of forty-five degrees (45°) to the left of the first direction, and wherein, when the deck is in the right position, the deck conveying structure receives the article being conveyed in the first direction at the second end and conveys the article in a third direction of forty-five degrees (45°) to the right of the first direction.

11 Claims, 3 Drawing Sheets

ADJUSTABLE RIGHT ANGLE TRANSFER DEVICE FOR CONVEYING FLAT ARTICLES IN ONE OF TWO DIRECTIONS

FIELD OF THE INVENTION

This present invention relates generally to a method and apparatus for changing the direction of motion of flat articles, and in particular to method and apparatus for changing the direction of motion of mailpieces in an inserter machine.

BACKGROUND OF THE INVENTION

Devices are known which turn flat articles, such as letter envelopes, within a plane. These devices are required where envelopes are discharged from an inserter and are not properly oriented to be fed to a downstream device such as a franking machine. An inserter is a machine that inserts selected items in an envelope for further processing. The filled envelope is sealed and then conveyed to a franking machine to have postage imprinted thereon. Generally, turner devices have the disadvantage of having to be an integral part of the inserting machine.

Examples of devices which turn flat articles in inserting machines are shown in U.S. Pat. No. 4,726,461 issued Feb. 23, 1988 to J. Pokrinchak and U.S. Pat. No. 4,928,807 issued May 29, 1990 to D. Auerbach, both of which patents are assigned to the assignee of the present invention.

It is known to change the direction of travel for flat articles without changing the orientation of the articles, i.e., without rotating or turning the articles. It is also known that for a one stage right angle change in direction the articles must be stopped in one direction before being conveyed in the right angled direction. Such a device is described in U.S. Pat. No. 4,909,374 issued Mar. 20, 1990 to M. Skrypalle and assigned to the assignee of the present invention.

It is also known that a right angle change of direction for flat articles can be achieved in two or more stages by the use of deflection rollers which change the direction of travel by forty-five degrees (45°) or less at each stage. Such an apparatus and method used in a sorting machine is disclosed in U.S. Pat. No. 4,527,792 issued Jul. 9, 1985 to G. Burkhardt. The Burkhardt apparatus has several limitations which prevent it from being useable in an inserting machine. The apparatus is limited to changing the direction of travel from a path parallel to a long edge of the mailpiece to a path of travel parallel to the short edge thereof. Furthermore, for all sized mailpieces, the Burkhardt apparatus requires a side-justified line of travel along the first direction of travel so that the deflection rollers can engage the article at the right moment to achieve an accurate change in direction. Typically, in an inserter, the center line of travel of the mailpiece is fixed with the side guides being adjustable for handling various sized mailpieces.

Several improvements in the throughput of various upstream modules (such as feeders, accumulators and insert stations) have raised the expectation that the output of the inserting machine will keep up with such improvements. However, when the output is increased on inserters which include conventional turner devices, the turner devices are not maintaining the increased output rate. The turner devices are experiencing various problems when they are operated at higher speeds. For example, inserts are flying out of envelopes before the flap can be closed and turner components are malfunctioning.

In U.S. Pat. application Ser. No. 608,512, filed on Nov. 2, 1990 and assigned to the assignee of the present invention, a method and apparatus is disclosed for changing the direction of motion of flat articles being conveyed along a first path to a second path. The apparatus includes a deck having a first side for receiving an article from a first direction and a second side for conveying the article in a second direction which forms an acute angle equal to or less than forty-five degrees (45°) with the first direction. There is a structure which includes a plurality of angled roller pairs for conveying the article over the deck in the second direction. The conveying structure engages a leading edge of the article only after the article has been disengaged by a conveying structure in the first direction. There is a registration wall positioned downstream from the second direction conveying structure adjacent a third side of the deck. The registration wall extends a third direction whereby the registration wall is at a right angle to the first direction, wherein the leading edge of the article is driven against the registration wall after the article has been disengaged by the second direction conveying structure. There is a structure for conveying the article in the third direction after the article is against said registration wall.

In U.S. Pat. application Ser. No. 732,862, filed on Jul. 19,1991 and assigned to the assignee of the present invention, a method and apparatus is disclosed for aligning while changing the direction of motion of flat articles being conveyed along a first path to a second path. The apparatus includes an adjustable registration wall in combination with an angled roller assembly that perform the dual function of conveying the article in the third direction and aligning the article against the registration wall. This apparatus solved registration problems, such as the article crashing into the registration wall and rebounding away from the wall while being conveyed at high speed in the third direction.

SUMMARY OF THE INVENTION

It has been found that the foregoing apparatus and methods for changing the direction of motion of a flat article can be configured in an assembly wherein one adjustable configuration can be used to change direction ninety degrees to the left or right of the original direction of motion of the article.

In accordance with the present invention, an apparatus is provided for changing the direction of travel of a flat article being conveyed in a first direction to one of two other directions without changing the orientation of the article. The apparatus comprises a circular deck mounted on a frame. The deck is pivotable along a center axis of the deck between a left position and a right position. There is structure operatively coupled to the deck for conveying the article over the deck, the deck conveying structure having a first end and a second end, wherein, when the deck is in the left position, the deck conveying structure receives the article being conveyed in the first direction at the first end and conveys the article in a second direction of forty-five degrees (45°) to the left of the first direction, and wherein, when the deck is in the right position, the deck conveying structure receives the article being conveyed in the first direction at the second end and conveys the article in a third direction of forty-five degrees (45°) to the right of the first direction.

The apparatus further comprises a left alignment assembly including a left registration wall situated adjacent the deck at a location corresponding to the second end of the deck conveying means when the deck is in the left position. The left registration wall extends a fourth direction at a right angle to the left of the first direction. There are means for conveying the article in the fourth direction after the article is against the left registration wall. A right alignment assembly includes a right registration wall situated adjacent the deck at a location corresponding to the first end of the deck conveying means when the deck is in the right position. The right registration wall extends a fifth direction at a right angle to the right of the first direction. There are means for conveying the article in the fifth direction after the article is against the registration wall, wherein the leading edge of the article is driven against a respective one of the registration walls after the article has been disengaged by the deck conveying means.

BRIEF DESCRIPTION OF THE DRAWINGS

A complete understanding of the present invention maybe obtained from the following detailed description of the preferred embodiment thereof, when taken in conjunction with the accompanying drawings wherein like reference numerals designate similar elements in the various figures, and in which.

DESCRIPTION OF THE PREFERRED EMBODIMENT

Figure 1:
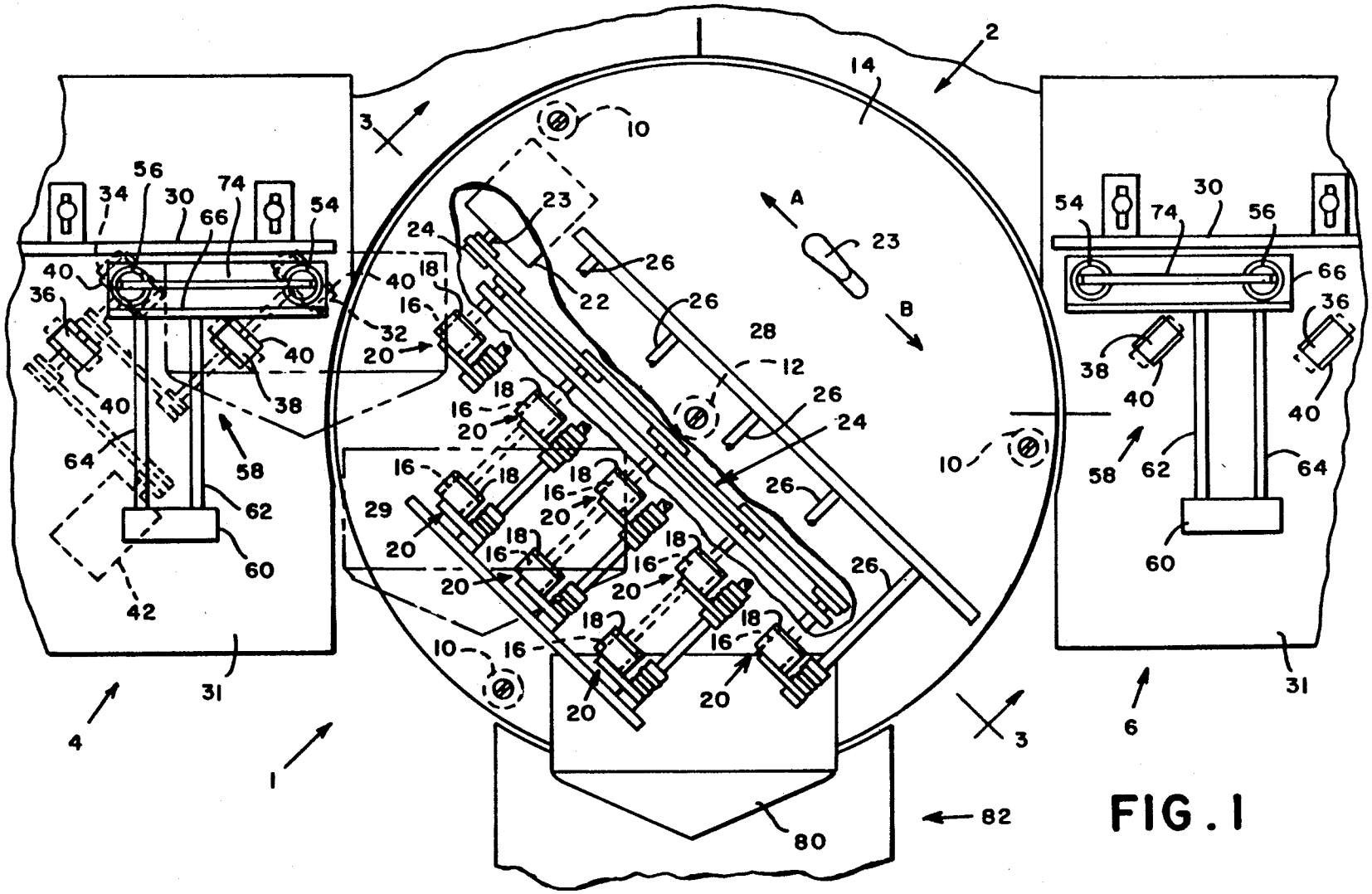
FIG. 1 is a plan view of a ninety degree take away assembly connected in accordance with the present invention configured to change the direction of travel to the left.

Referring now to the Figures, there is shown a pivotable ninety degree transfer assembly, generally designated 1, that includes a bidirectional forty five degree take away unit, generally designated 2, and two alignment apparatus, generally designated 4 and 6. Take away unit 2 includes a circular deck 14 that is pivotably situated at an elevated position above a lower frame 8. Deck 14 is supported in the elevated position by three legs members 10 that are equally spaced from one another around the periphery of deck 14. There is a center pivot shaft 12 affixed to the center of the underside of deck 14 and pivotably extending through a hub 13 bolted to lower frame 8. Leg members 10 include casters 11 which facilitate the pivoting of deck 14 about center pivot shaft 12. Leg members 10 and center pivot shaft are secured to the underside of deck 14 in a known manner, for example by recessed screws, so as not to interfere with the material being conveyed on deck 14.

Take away unit 2 includes a roller conveying arrangement comprising eight pairs of driven and idler rollers for conveying envelopes 80 away from insert station 82. Deck 14 includes eight rectangular slots 18 each having projected in part from below deck 14 a continuously driven roller 16 above which an idler roller assembly 20 is suspended. Below deck 14, there is a motor 22 mounted to the underside of deck 14 so as not to interfere with the pivoting motion of deck 14 or with the material being conveyed on deck 14. Motor 22 is part of a conventional shaft and pulley drive system, generally designated 24, for driving driven rollers 16. In the preferred embodiment of the present invention, motor 22 is a conventional variable speed D.C. motor whereby the speed of driven rollers 16 can be adjusted to optimize the throughput of take away unit 2 relative to the speed of other modules in the inserting machine.

Above deck 14 are eight idler roller assemblies 20 positioned respectively above driven rollers 16. Each idler roller assembly 20 includes a supporting shaft 26 fixedly mounted at one end to the plate 28, which is secured to deck 14, and at the other end to plate 29 for supporting idler roller assembly 20. Plate 29 is supported by shafts 26 and is suspended above deck 14. A more detailed description of the roller conveying arrangement of take away unit 2 is provided in U.S. Pat. application Ser. No. 608,512, filed on Nov. 2, 1990 and assigned to the assignee of the present invention, which is incorporated herein by reference.

Figure 2:
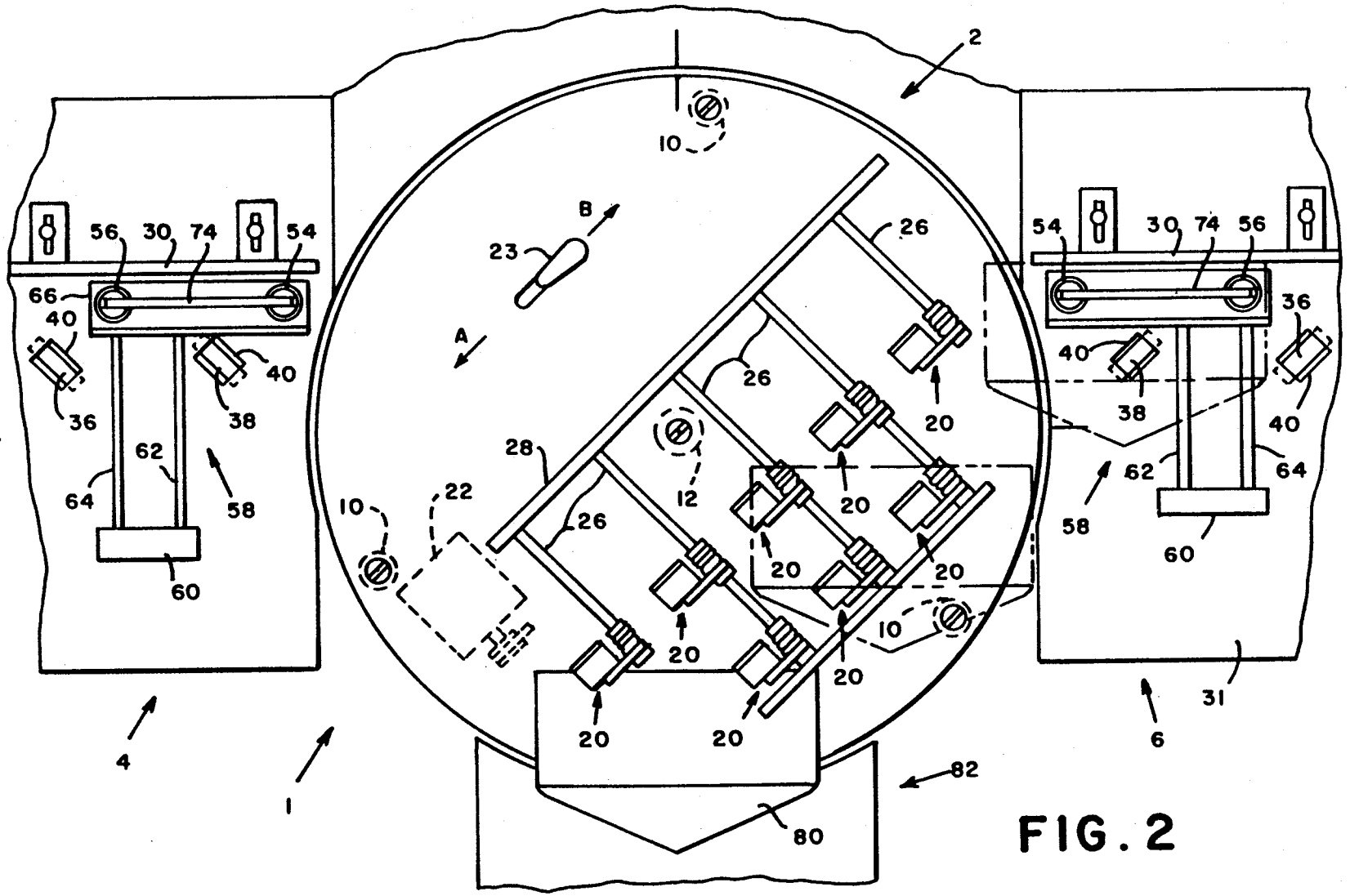
FIG. 2 is a plan view of the take away assembly in FIG. 1 configured to change the direction of travel to the right.
Figure 3:
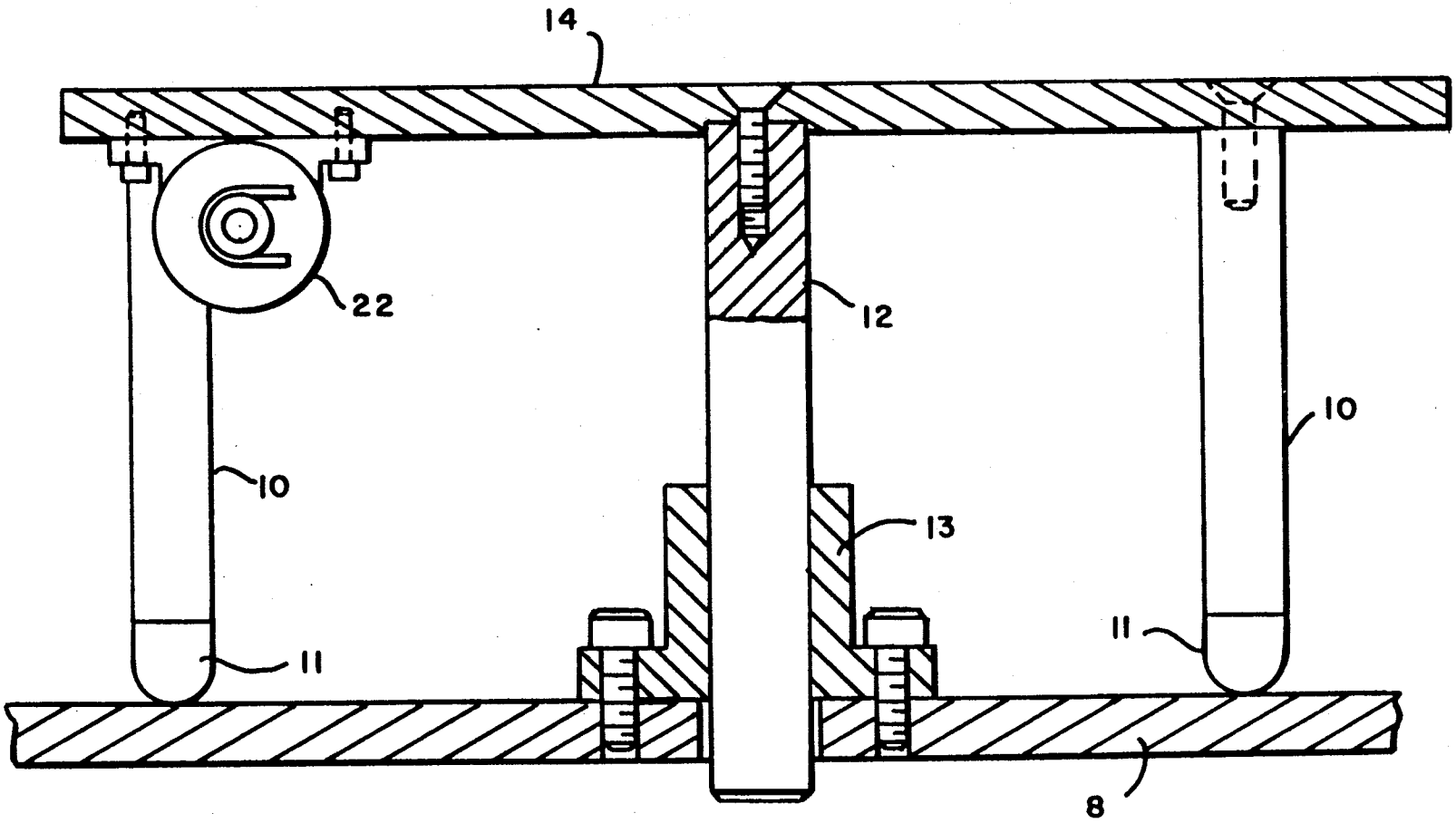
FIG. 3 is a side view of the take away assembly in FIG. 1 taken along lines 3—3.

There is a switch 23 mounted on the surface of deck 14. Switch 23 is connected to motor 22 to control the polarity of motor 22. When switch 23 is in position "A", as seen in FIG. 1, driven rollers 16 rotate in the direction of arrow A. When switch 23 is in position "B", as seen in FIG. 2, driven rollers 16 convey rotate in the direction of arrow B.

The following description of alignment apparatus 4 applies also for alignment apparatus 6 which is a mirror image of apparatus 4. Alignment apparatus 4 includes a registration wall 30 adjustably mounted to deck 31. There are four driven rollers 32, 34, 36 and 38 which are located below deck 31 and which are projected in part through four rectangular slots 40 in deck 31. Below deck 31, there is a conventional drive system, similar to drive system 24, which includes motor 42, preferably of a variable speed type, and a conventional belt and pulley configuration for driving rollers 32, 34, 36 and 38.

Rollers 32, 34, 36 and 38 are angled 45° towards registration wall 30 for conveying the envelope 26 in two directions, i.e., towards the registration wall 30 and towards the downstream device (not shown), for example, a device for sealing envelope 26. The angle of rollers 32, 34, 36 and 38 matches the angle of the driven rollers of take away unit 2 to prevent any unnecessary skewing of the envelope as it passes from the control of take away unit 2 to alignment apparatus 4.

Normal force is applied to rollers 32 and 34 by a pair of free floating roller balls 54 and 56 each of which is suspended in a roller ball retaining assembly generally designated 58. Roller ball retaining assembly 58 includes a mounting block 60 rigidly connected to deck 31 opposite registration wall 30. Two rigid shafts 62 and 64, for example, thick steel shafts, are rigidly mounted at one end to mounting block 60, and at the other end to a suspending plate 66, whereby suspending plate 66 is cantilevered over rollers 32 and 34. Suspending plate 66 has two apertures through which a pair of cups (not shown) are inserted for holding free floating roller balls 54 and 56. Each cup has an upper rim which sits on plate 66. There are a pair of caps (not shown) which fit into the cups and rest over roller balls 54 and 56. A leaf spring 74 is secured to the center of plate 66 by a pair of screws and each end of leaf spring 74 sits on one of the caps. Each cap is slotted for receiving an end of leaf spring 74. Leaf spring 74 applies a force against the caps, which in turn apply pressure to roller balls 54 and 56. Roller balls 54 and 56, cups and caps can easily be replaced by lifting the respective end of leaf spring 74 to remove the cap, cup and ball. Roller balls 54 and 56 rotate in any direction and do not impede the sudden change in direction when the envelope hits registration wall 30. The cups, caps and balls are made of light weight and wear resistant material that minimizes the normal force applied against rollers 32 and 3 and reduces the wear of roller balls 54 and 56 as they rotate. A more detailed description of the roller conveying arrangement of alignment apparatus 4 is provided in U.S. Pat. application Ser. No. 732,862, filed on Jul. 19, 1991 and assigned to the assignee of the present invention, which is incorporated herein by reference.

In operation, deck 14 is positioned in one of two positions. A right angle transfer to the left occurs when deck 14 is positioned, as shown in FIG. 1, with driven rollers 16 situated between insert station 82 and alignment apparatus 4. Switch 23 is in the A position and driven rollers 16 are rotating towards alignment apparatus 4. In this configuration, take away unit 2 conveys envelope 80 along a 45° path to alignment apparatus 4 which completes the right angle transfer. When envelope 80 enters the nip of roller 32 and roller ball 54, the envelope is urged against registration wall 30. Envelope 80 is then conveyed by rollers 32, 34, 36 and 38 along registration wall 30. If envelope 80 enters the nip of roller 32 and roller ball 54 skewed, the envelope is quickly deskewed by rollers 32 and 34 urging envelope 80 against registration wall 30. The normal force applied by roller balls 54 and 5 against rollers 32 and 34 prevents envelope 80 from bouncing off the wall. It will be understood that the combined effort of rollers 32 and 34, roller balls 54 and 56, and registration wall 30 provides a quick and lasting alignment of envelope 80 against registration wall 30.

A right angle transfer to the right occurs when deck 14 is positioned, as shown in FIG. 2, with driven rollers 16 situated between insert station 82 and alignment apparatus 6. Switch 23 is in the B position and driven rollers 16 are rotating towards alignment apparatus 6. In this configuration, take away unit 2 conveys envelope 80 along a 45° path to alignment apparatus 6 which completes the right angle transfer as previously described. It has been found that the present invention works equally as well for the right angle transfer of envelopes in either direction.

In the preferred embodiment of the present invention, deck 14 is manually rotated about the axis of pivot shaft 12. Stops, such as blocks (not shown) mounted on frame 8, are used to stop the rotation of deck 14 at each of the desired positions. It will be understood by those skilled in the art that the symmetrical arrangement of take away unit 2 at the two positions with respect to the axis of pivot shaft 12 promotes the bidirectional operation of take away unit 2. Alternate methods of rotating deck 14 can be used, such as, an electromechanical arrangement including a servo motor to rotate deck 14 from one position to the other. It has been found that it is unnecessary to lock deck 14 in place once positioned, although a locking mechanism can be used to ensure that deck 14 does not move from alignment.

In the preferred embodiment of the present invention, driven rollers 16 have a rubber surface, for example, a urethane surface, and idler rollers 20 are aluminum with a crown surface. It has been found that take away unit 2 conveys envelopes of various dimensions and thickness in both directions using such rollers comprising such surface.

Typically, the downstream apparatus (not shown) in an inserter will have a registration wall which is adjustable to handle different sized envelopes. Registration walls 30 of alignment apparatus 4 and 6 are adjustable for handling different sized envelopes and for alignment with the downstream registration walls.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. An apparatus for changing the direction of travel of a flat article being conveyed in a first direction to one of two other directions without changing the orientation of the article, comprising:

a circular deck mounted on a frame, said deck being pivotable along a center axis of said deck between a left position and a right position;

means operatively coupled to said deck for conveying the article over said deck, said deck conveying means having a first end and a second end, wherein, when said deck is in said left position, said deck conveying means receives the article being conveyed in the first direction at said first end and conveys the article in a second direction of forty-five degrees (45°) to the left of said first direction, and wherein, when said deck is in said right position, said deck conveying means receives the article being conveyed in the first direction at said second end and conveys the article in a third direction of forty-five degrees (45°) to the right of said first direction.

2. The apparatus according to claim 1 further comprising:

a left alignment assembly including a left registration wall situated adjacent said deck at a location corresponding to said second end of said deck conveying means when said deck is in said left position, said left registration wall extending a fourth direction at a right angle to the left of said first direction, and means for conveying the article in said fourth direction after said article is against said left registration wall; and a right alignment assembly including a right registration wall situated adjacent said deck at a location corresponding to said first end of said deck conveying means when said deck is in said right position, said right registration wall extending a fifth direction at a right angle to the right of said first direction, and means for conveying the article in said fifth direction after said article is against said registration wall, wherein said leading edge of the article is driven against a respective one of said registration walls after the article has been disengaged by said deck conveying means.

3. The apparatus according to claim 1 wherein said deck conveying means engages a leading edge of the article only after the article has been disengaged by a conveying means in the first direction.

4. The apparatus according to claim 1, wherein said deck conveying means comprise a plurality of roller pairs.

5. The apparatus according to claim 4, wherein each of said roller pairs includes a spring biased idler roller assembly and a driven roller.

6. The apparatus according to claim 5, wherein said driven roller is driven by a D.C. motor, said motor being coupled to a polarity switch for controlling the direction of rotation of said driven rollers.

7. The apparatus according to claim 6, wherein said driven roller speed is less than a speed of a first direction conveying means.

8. The apparatus according to claim 1, wherein said left position of said deck is ninety degrees counterclockwise from said right position.

9. The apparatus according to claim 1, wherein said left and right registration walls are adjustably positioned to handle various sized envelopes.

10. A method for changing the direction of motion of flat articles being conveyed seriatim along a first path to one of two paths which are at a right angles to the first path without changing the orientation of the flat article, the method comprising the steps of:

a) determining a first change in direction;

b) rotating a deck plate containing a deck conveying assembly to a position corresponding to said deck conveying assembly being positioned at a forty-five degree (45°) angle from the first path to the first change in direction;

c) energizing said deck conveying assembly to convey the articles towards the first change in direction;

d) conveying the articles to said deck conveying assembly;

e) engaging the leading edge of each of said articles by at least two of a plurality of roller pairs comprising said deck conveying means after the article has been disengaged by a drive means along said first path, said roller pairs being configured in at least two parallel rows, each of said roller pairs being angled in a direction which is equal or less than forty-five degrees (45°) from said first path;

f) conveying each of the articles across said deck plate;

g) driving the leading edge of each article against a corresponding registration wall after the article has been disengaged by the roller pairs of said deck conveying means, said registration wall being positioned at the desired right angle to the first direction and downstream of the roller pairs; and h) conveying each of the articles along the registration wall by a roller means.

11. The method according to claim 10, further comprising the steps of:

i) rotating said deck plate to a second position corresponding to said deck conveying assembly being positioned at a forty-five degree (45°) angle from the first path to a second change in direction to convey the articles in a direction opposite to the first change in direction in step a; and j) energizing said deck conveying assembly to convey the articles towards second the change in direction.

* * * * *